United States Patent [19]

Stilwell

[11] 4,427,358

[45] Jan. 24, 1984

[54] SECTIONAL CONCRETE SCREED MACHINE

[76] Inventor: Leo J. Stilwell, 31870 Peavine St., Dowagiac, Mich. 49047

[21] Appl. No.: 339,545

[22] Filed: Jan. 15, 1982

[51] Int. Cl.[3] ..... B28B 1/08

[52] U.S. Cl. ..... 425/432; 404/119; 404/120; 425/456

[58] Field of Search ..... 425/456, 458, 432; 404/118, 120, 114, 96, 119; 403/337, 340, 341, 408, 286

[56] References Cited

U.S. PATENT DOCUMENTS

| | | | |
|---|---|---|---|
| 3,074,519 | 1/1963 | Soeder | 403/408 |
| 3,220,757 | 11/1965 | Potter | 403/408 |
| 3,435,740 | 4/1969 | McGall | 404/119 |
| 3,466,074 | 9/1969 | Heth | 403/337 |
| 4,030,873 | 8/1977 | Morrison . | |
| 4,213,749 | 7/1980 | Morrison | 404/120 |
| 4,340,351 | 7/1982 | Owens | 264/69 |

OTHER PUBLICATIONS

Brochure of H. Compton Co.
Brochure of Allen Engineering Corporation.
Brochure of AWS Manufacturing, Inc.
Brochure of KEG Manufacturing Company
Brochure of Curbmaster of America, Inc.

*Primary Examiner*—Donald E. Czaja
*Assistant Examiner*—Mary A. Becker
*Attorney, Agent, or Firm*—Flynn, Thiel, Boutell & Tanis

[57] ABSTRACT

A knock-down vibrating concrete screed comprises elongate screed units attachable end-to-end in a longitudinally extending row to provide a screed of desired length. Ones of the screed units each comprise an elongate frame unit movable transversely over the concrete and vibration apparatus for vibrating the corresponding frame unit for smoothing the concrete over which the frame unit moves. The adjacent ends of the screed units positively block coaxially longitudinal movement of adjacent screed units into attached relation with each other. The adjacent ends of the screed units also block strictly coaxial longitudinal movement of attached screed units out of attached relation with each other. Further, the adjacent ends of adjacent screed units are attachable to each other by longitudinal overlapping, followed by movement one toward the other in one direction transverse to the length of the screed into an attached position of longitudinal alignment in which the longitudinally overlapped ends positively block further movement in such one direction. Quick change devices require no tools to connect and disconnect adjacent screed unit ends. A motor is mounted on one of the screed units, and can be placed at any desired location along the length of the screed, for driving the vibration apparatus to vibrate the screed. A winch support member is releasably lockable at alternate locations on and along the screed units by a quick change device not requiring tools, for forwardly propelling the screed across concrete to be smoothed.

21 Claims, 15 Drawing Figures

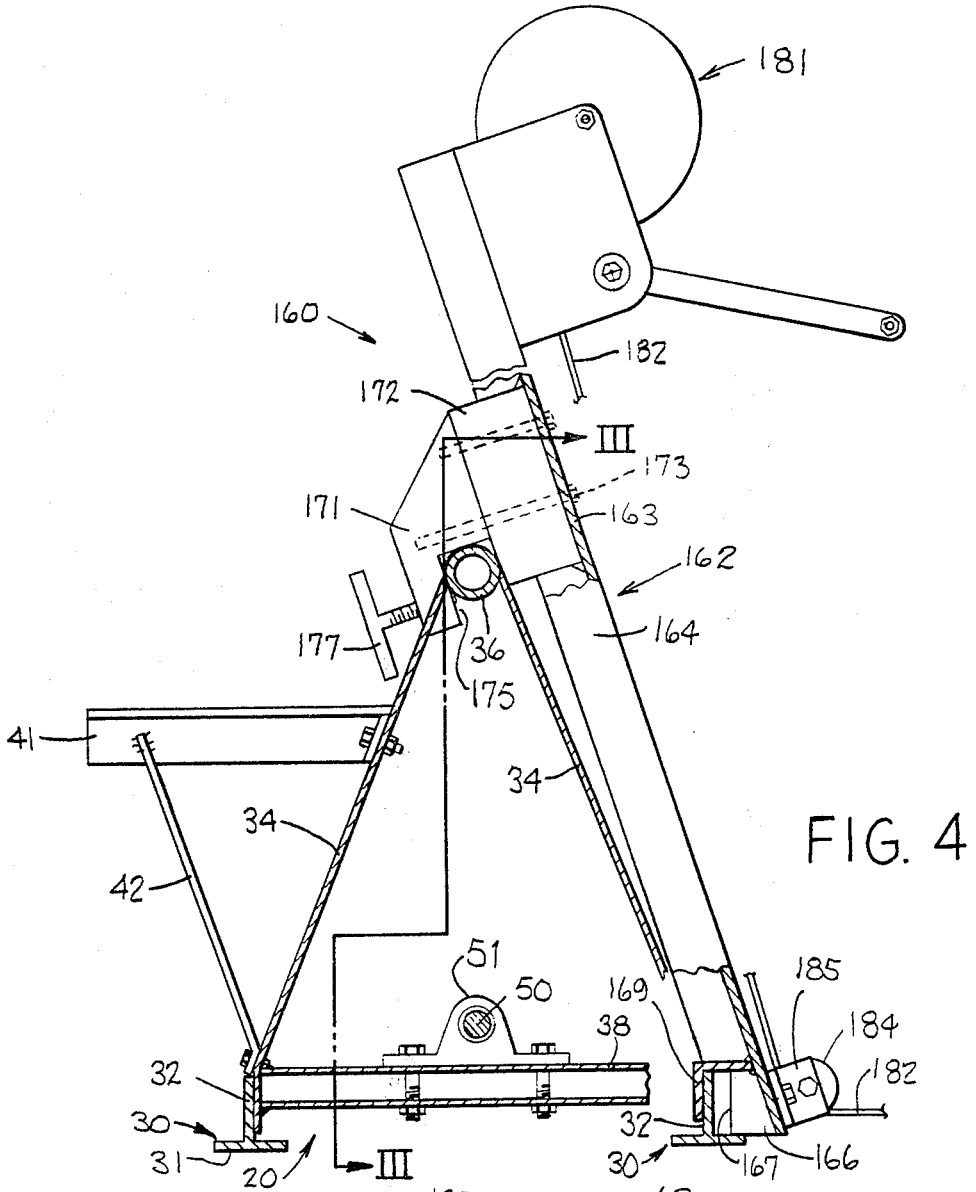
FIG. 4
FIG. 5
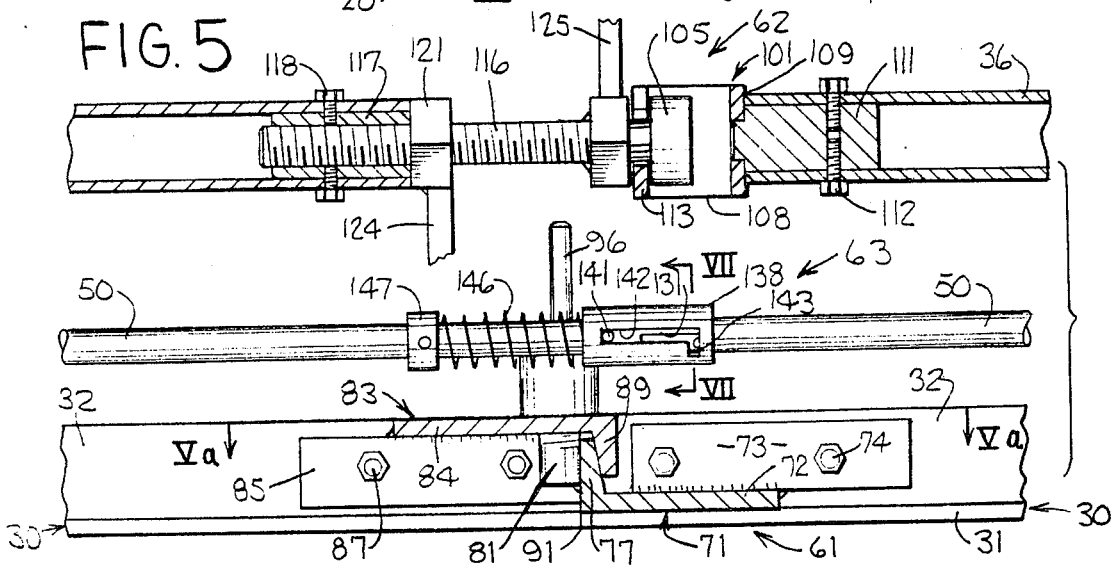

FIG. 12
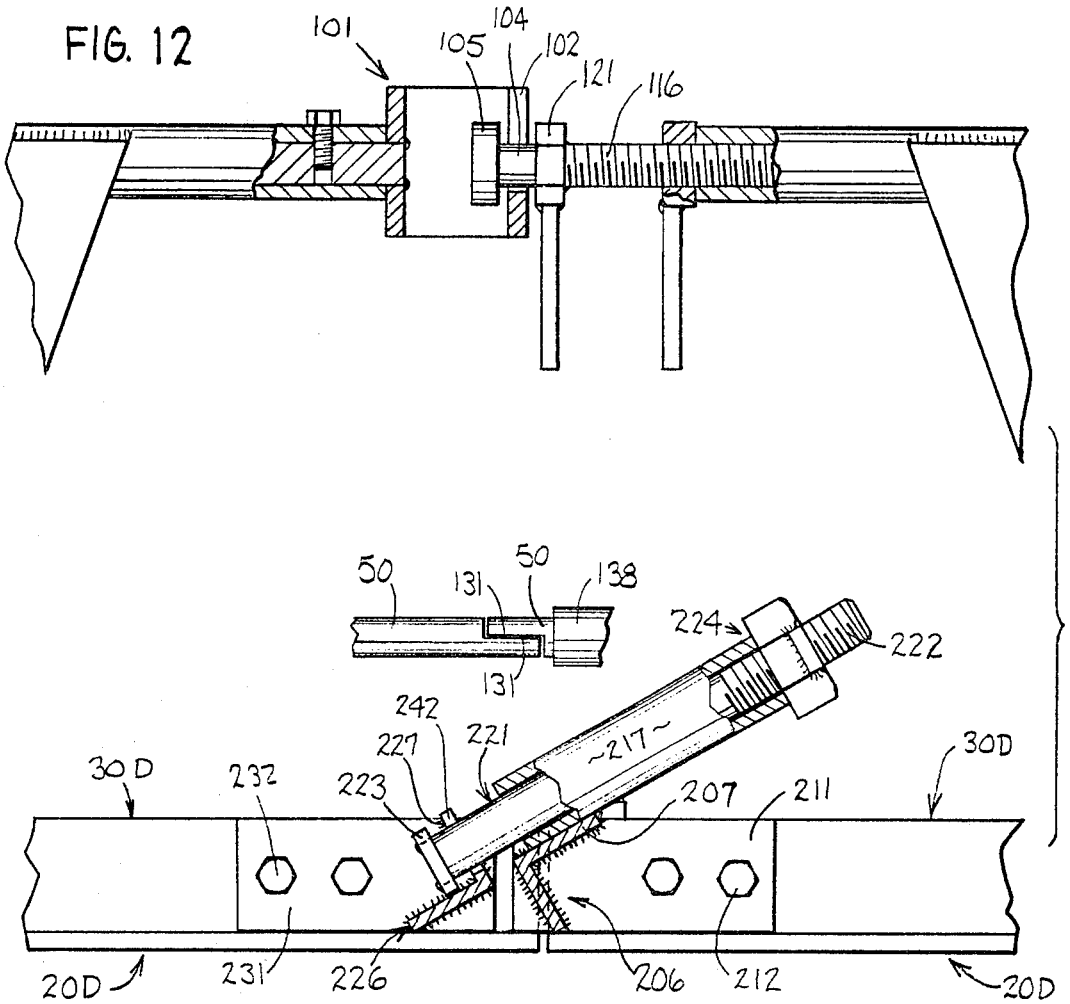
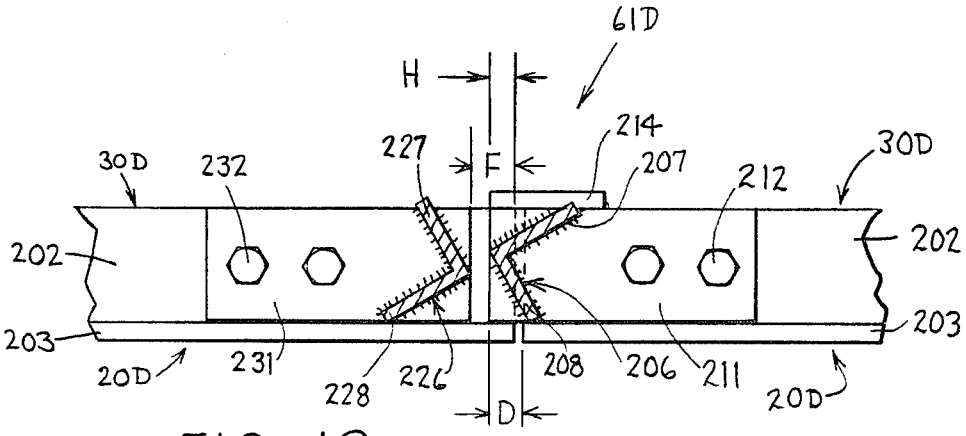
FIG. 13

SECTIONAL CONCRETE SCREED MACHINE

FIELD OF THE INVENTION

This invention relates to a knock-down vibrating concrete screed for smoothing of large concrete areas.

BACKGROUND OF THE INVENTION

Prior portable vibrating concrete screeds of which I am aware have been of the type in which a plurality of longitudinally extending screed units are connectable end-to-end to form a screed of any of several possible lengths, depending on the lengths and number of screed units employed. Typically, a motor is mounted on one of the screed units to drive vibration-inducing shaft sections on the connected screed units. U.S. Pat. No. 4,030,873 (Morrison) defines an example of such a prior art screed.

It has also be known to mount a hand-powered winch on a fixed bracket at the end of the screed to advance, the screed forwardly along the concrete area to be smoothed, the forward end of the winch line being fixed, as by stakes or the like, to the ground at some location ahead of the screed.

However, the portable, multi-unit, vibrating screeds of which I am aware have not been entirely satisfactory for a number of reasons. First, the bottom frame members of adjacent screed units have normally been connected together on the job site by through-bolting upstanding webs of the bottom rails of one screed unit to overlapping plates which are fixed to and extend longitudinally beyond the upstanding webs of the bottom rails of the adjacent screed unit. However, it is these bottom rails which engage and quickly become coated with concrete during screeding as do the bolts extending therethrough. Moreover, in order to maintain the portable screed units acceptably light in weight, the upstanding webs are necessarily relatively small and the through bolts are relatively small also, for example less than 3/8 inch diameter and typically 5/16 inch or $\frac{1}{4}$ inch diameter. Accordingly, it becomes difficult and time consuming to release and reinstall these small bolts and their corresponding nuts, in view of the small size thereof, their correspondingly relatively fine threads, and their insertion through the concrete smoothing members.

Further, it is typical in the prior art to effect connection of adjacent screed units by moving one toward another longitudinally, in coaxial relation, until plates at the top and bottom frame rails and on the shaft section of one screed unit laterally overlap the ends of the top and bottom rails and shaft section on the adjacent screed unit. However, it is often difficult to achieve the desired alignment of two bottom rails, one or two top rails and a shaft section of one screed unit with the corresponding parts of the adjacent screed unit while longitudinally pulling into position one of the relatively long and bulky screed units. Moreover, it is also difficult and time consuming to align bolt holes in the various members simultaneously to allow through-bolting.

In addition, depending on conditions, a pair of screed units may tend to either sag or buckle upwardly at their connected ends and it is difficult to overcome this tendency and maintain precise coaxial alignment of adjacent screed sections with a simple through-bolting of overlapped frame rails or, as in aforementioned U.S. Pat. No. 4,030,873, with a simple pressure clamp arrangement for joining the top frame rails.

In addition, means for adjusting the vibration amplitude on prior art screeds of which I am aware have not been satisfactory and it is typical, as in the aforementioned patent, to not provide for any such adjustment, despite the fact that the ability to adjust vibration amplitude is desirable to adapt the screed to varying conditions of weather, concrete thickness and stiffness, and the like.

Further, on prior art screeds of which I am aware, the motor has normally been mounted on the endmost screed unit, which also typically has nonremovably fixed thereon the winch mount. Accordingly, the motor cannot be located, should such be desired, in the middle of the assembled screed. Furthermore, the winch mount cannot be relocated along the length of its particular screed unit nor can it be mounted on other screed units comprising the completed screed.

The objects and purposes of this invention include provision of a lightweight, portable, knock-down, multiunit screen which can be assembled on a job site and adapted to the conditions at hand, and which, subsequently to completion of the screeding operation, can be disassembled for shipping to another job site, all with minimized input of time and labor, so as to minimize time and labor costs for the screeding job as a whole, particularly when screeding relatively small concrete areas wherein actual screeding time is relatively short.

A further object of this invention is to provide a screed as aforesaid in which the screed units are connected by quick change connectors not requiring tools, which are relatively unaffected by engagement with concrete, and which are positively adjustable to control upward or downward bowing of the screed at the interconnection of screed units. A further object is to provide an apparatus as aforesaid in which screed units are joinable by transversely dropping the end of one upon the adjacent end of another, wherein, without more, the adjacent screed units are fixed with respect to each other in a horizontal plane, both longitudinally and transversely of the screed.

A further object of the invention is to provide a screed as aforesaid in which the screed unit supporting the motor can be located at any desired location in the multi-unit screed, and in which a winch support may be located at any of several permitted locations on a given screed unit or on any desired one of several screed units.

Further objects and purposes of this invention will be apparent to persons familiar with apparatus of this general type upon reading the following description and inspecting the accompanying drawings.

The objects and purposes of the invention are met by providing a knock-down vibrating screed comprising elongate screed units attachable at and in a longitudinally extending row to provide a screed of desired length. Ones of the screed units each comprise an elongate frame unit movable transversely over the concrete and vibration means for vibrating the corresponding frame unit for smoothing the concrete over which the frame unit moves. The adjacent ends of the screed units positively block strictly coaxial longitudinal movement of adjacent screed units into attached relation with each other. The adjacent ends of the screed units block strictly coaxial longitudinal movement of attached screed units out of attached relation with each other. Further, the adjacent ends of adjacent screed units are attachable by longitudinal overlapping, followed by movement one toward the other in one direction transverse to the length of the screed into an attached position of longitudinal coaxial alignment in which the longitudinally overlapped ends positively block further movement in the one transverse direction.

BRIEF DESCRIPTION OF THE DRAWINGS

FIG. 4 is a fragmentary, partially broken enlarged sectional view substantially taken on the line IV—IV of FIG. 3.

FIG. 5 is an enlarged, fragmentary, partially broken side view showing the two screed units of FIG. 3 in their attached condition.

FIG. 12 is a partially broken sectional view substantially on the cutting plane XII—XII of FIG. 11.

FIG. 13 is a fragmentary sectional view substantially taken on the line XIII—XIII of FIG. 11.

DETAILED DESCRIPTION

Figure 1:
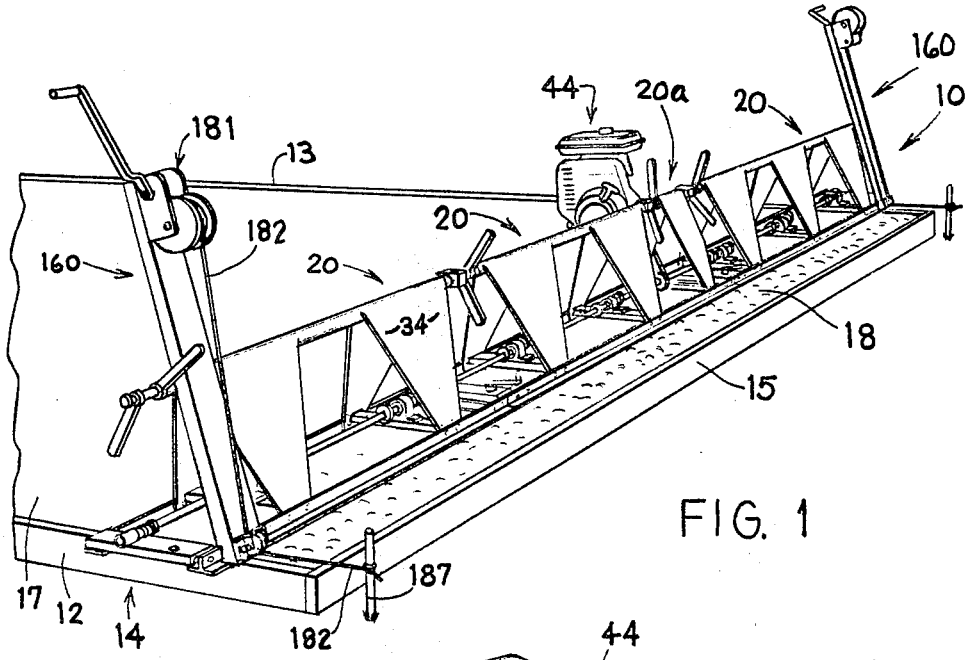
FIG. 1 is a pictorial view taken from the forward side of the screed embodying the invention, with the screed being shown in the process of smoothing a concrete area.

In FIG. 1 a multi-unit screed 10 embodying the invention rides near its ends on the top edges of side members 12 and 13 of a form 14 for movement forwardly (to the right in FIG. 1) toward a front end form member 15, the screed 10 having smoothed concrete 17 behind it and being about to smooth the still rough surface 18 of concrete ahead of it. The screed 10 is assembled in any desired length from one or more screed units 20, here including a motor mounting screed unit 20*a*, attached in end-to-end, longitudinally extending relation. It will be understood that the motor mounting screed unit 20*a* may be positioned as desired along the screed, either at an end thereof or intermediate other screed units 20. Screed units 20 may conveniently be all of the same length, or provided in a few different lengths (for example, 5 feet and 7½ feet) for assembly in a modular fashion to accommodate to various widths of concrete slab to be smoothed. If desired, and as shown in FIG. 1, the motor mounting screed unit 20*a* may be shorter than the rest, for example 1½ feet, to complement the above-mentioned module sizes, or half one of the other module lengths, or of other desired length.

Figure 3:
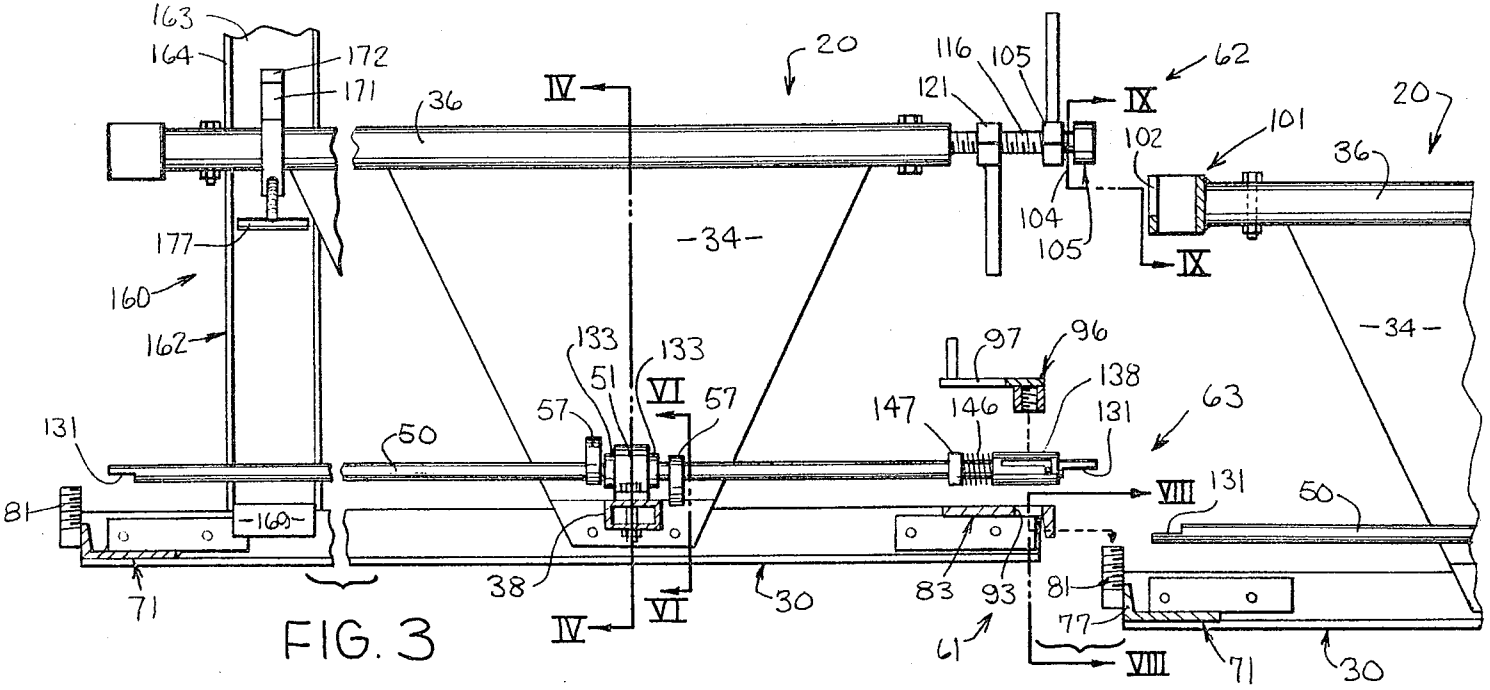
FIG. 3 is an enlarged, exploded, partially broken view of the FIG. 1 apparatus taken substantially from the rear side thereof (and substantially along the line III—III of FIG. 4), with two adjacent screed units in a position preparatory to attachment one to the other.

As seen in FIGS. 3 and 4, each screed unit is preferably substantially of triangular cross section and comprises a horizontally spaced pair of longitudinally extending bottom rails 30 having a concrete supported substantially horizontal bottom web 31 surmounted by an upstanding attachment web 32. In the embodiment shown, the bottom rails are of T-shaped cross section. Struts 34 support a longitudinal top rail 36 in vertically spaced horizontally preferably centered relation above the bottom rails 30. In the embodiment shown, the struts 34 are inverted, substantially trapezoidal plates fixed by welding at spaced intervals along the top rail 36 and diverging downward therefrom to overlap and be secured by bolts, rivets or the like to the upstanding webs 32 of the bottom rails 30. Horizontal cross members 38 are welded to and span the space between the bottom ends of the struts 34 to provide a rigid substantially triangular cross section. The cross members 38 are spaced above the bottom webs 31 and thus above the level of concrete smoothed by the bottom webs 31.

The screed units 20 will each normally be provided with at least two longitudinally spaced pair of such struts 34 (conveniently two or three as seen in FIG. 1). However, a very short screed unit, such as the motor supporting screed unit 20*a*, normally comprises a single pair of such struts 34, the longitudinal extent of the top and bottom edges of the struts 34 being adequate to assure against tilting of the top rail 36 with respect to the bottom rails 30. In such short motor supporting screed units, as shown with respect to alternative motor support screed units 20*b* (FIG. 2) and 20*c* (FIG. 10), additional cross members 39 may be provided in longitudinally offset relation from the struts 34.

Figure 2:
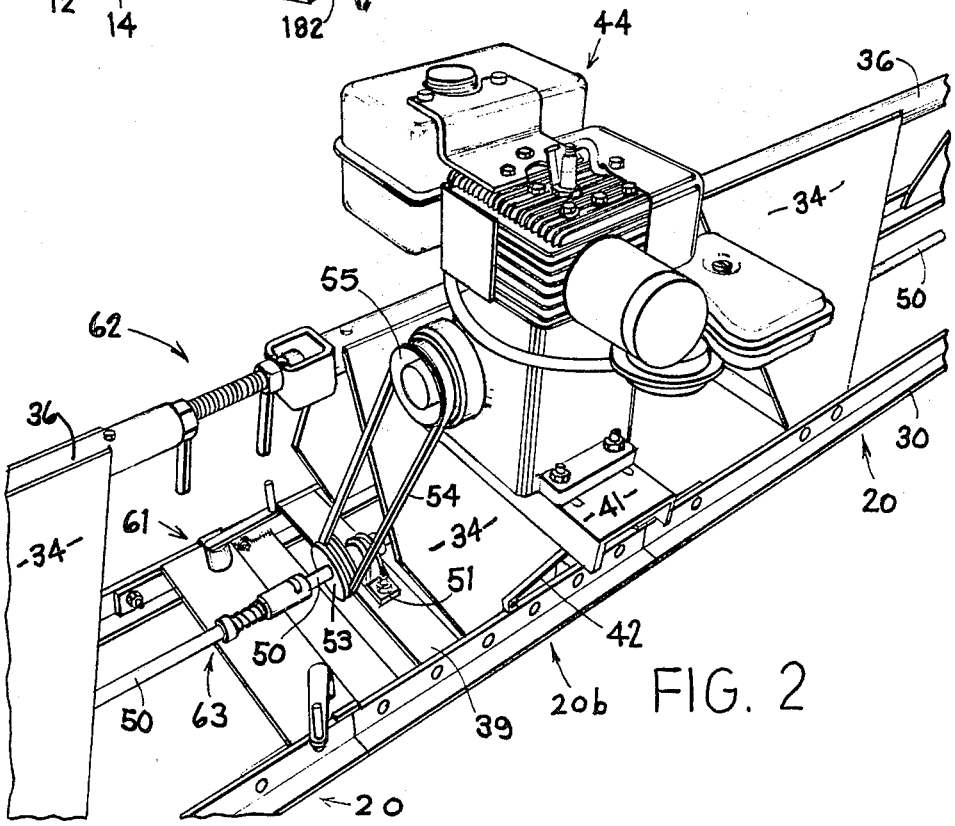
FIG. 2 is an enlarged pictorial fragment of a screed similar to that of FIG. 1 and showing the joinder of a pair of adjacent screed units, one of which supports the motor.
Figure 10:
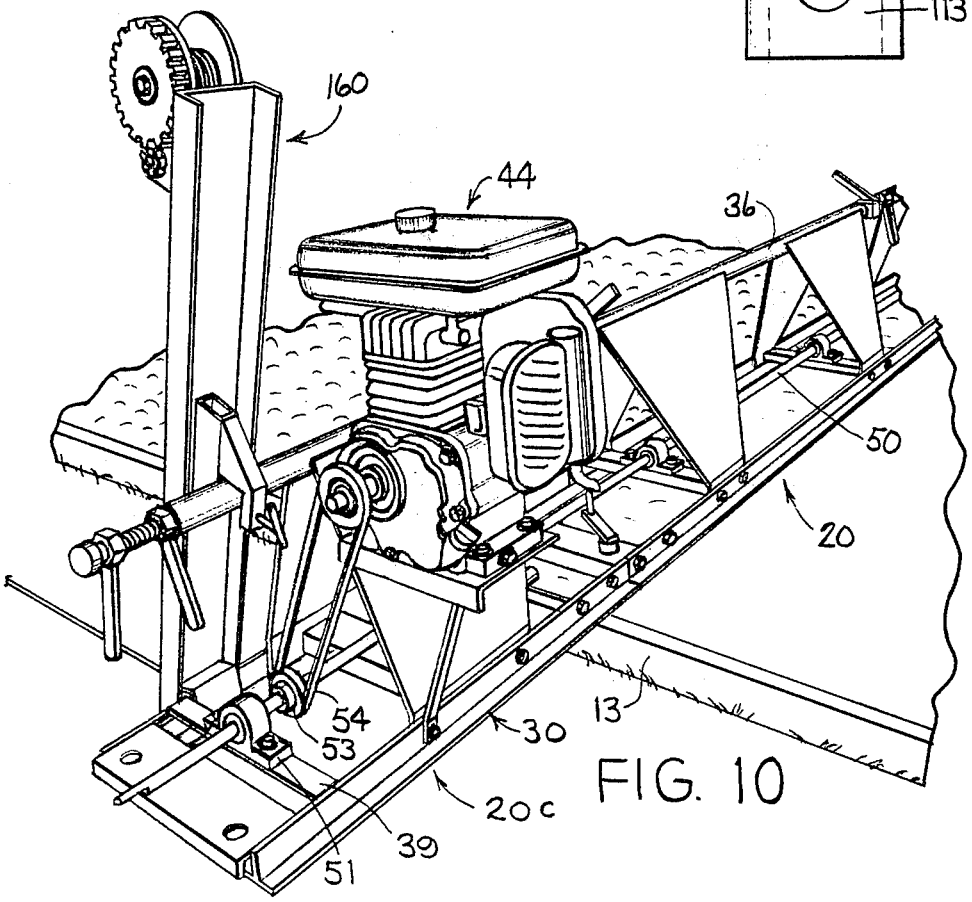
FIG. 10 is a forward looking pictorial view generally similar to FIG. 2 but showing a modified motor mounting screed unit, and location thereof at the end of the corresponding screed.

The motor mounting screed unit, for example as seen at 20*b* in FIG. 2, comprises a horizontal shelf 41 (FIGS. 2 and 4) fixed, as by bolting, in cantilevered relation to the upper portion of one of the struts 34, the outer end of the shelf 41 being supported by a brace 42 in turn bolted at its bottom end to the lower end of strut 34 (or to the adjacent bottom rail 30 as in FIG. 10). A motor 44 (preferably a compact gasoline engine, examples of which are shown in FIGS. 1 and 10 or FIG. 2) is bolted atop the shelf 41.

Each screed unit rotatably supports a longitudinally extending shaft segment 50 extending the length thereof and supported by at least a pair of bearings 51 near the opposite ends thereof, such bearings 51 being fixed atop corresponding cross member 38 or 39. The shaft segment 50 on the motor supporting screed unit 20*a*, 20*b*, or 20*c* (FIGS. 1, 2 and 10) has fixed thereon a pulley 53 driven by a belt 54 from a further pulley 55 fixed to the shaft of the engine 44. The driven pulley 53 preferably is disposed close to a corresponding bearing 51, either outboard thereof as in FIG. 2 or inboard thereof as in FIG. 10. The shaft segments 50 of adjacent screed units 20 are connected end-to-end, in a manner hereafter decribed in detail, such that one motor 44 can rotatably drive at a common speed the shaft segments of all of the connected screed units which make up the screed 10.

To cause the rotation of the shaft segments 50 to vibrate the screed units as needed to accomplish the vibratory screeding operation, eccentric weights 57

Figure 6:
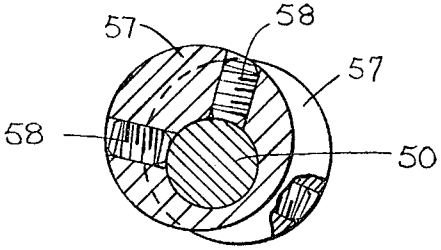
FIG. 6 is an enlarged, partially broken sectional view substantially taken on the line VI—VI of FIG. 3.

(FIGS. 3 and 6) are each fixed to the shaft segment 50 to permit circumferential adjustment with respect to the shaft segment 50. In the preferred embodiment shown, each eccentric weight 57 is positively fixed to the shaft segment 50 by a pair of set screws 58, here at about right angles to each other. A pair of such eccentric weights 57 preferably flank in closed spaced longitudinal relation each of the bearings 51 supporting the corresponding shaft segment 50, or at least the two endmost such bearings. In this way, the radial forces generated by the rotating eccentrics, namely the radially directed vibratory forces, are imparted directly through the bearing to the bottom rails 30 defining the bottom portion of the frame of the screed unit 20, while minimizing flexure of the shaft segment 50 and any tendency to cock the shaft segment with respect to the bearing and consequently wear the bearing 51. By placing the centers of mass of the two adjacent eccentrics 57 diametrally opposite each other (at 180° separation), the eccentricity of the masses tends to cancel and resultant vibration of the shaft segment 50 is virtually nil. On the other hand, circumferential adjustment of one of the eccentrics 57 to place its center of mass in longitudinal alignment with the center of mass of the adjacent eccentric 57 maximizes the eccentric weighting of the shaft segment 50 and hence maximizes the vibrational amplitude imparted to the bottom rails 30 of the frame of the screed unit 20. The paired eccentrics 57,57 of FIG. 6 are shown in an intermediate position between zero and 180° out of phase to impart an intermediate degree of vibration to the screed unit 20.

The adjacent ends of adjacent screed units 20 are equipped with quick connect-disconnect, drop-in connecting units indicated generally at 61, 62 and 63 for respectively connecting the bottom rails 31, top rails 36 and shaft segments 50 of adjacent screed units 20.

Figure 5A:
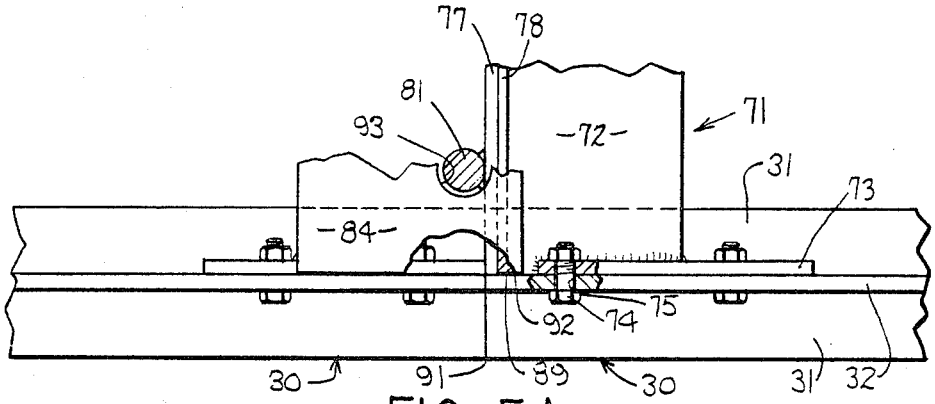
FIG. 5A is a partially broken fragmentary cross-sectional view substantially taken on line Va—Va of FIG. 5.

The bottom rail connecting unit 61 (FIGS. 2, 3 and 5) preferably comprises a substantially L section cross member 71 extending between the ends of the bottom rails 30 of the rightward screed unit 20. The L section member 71 comprises a horizontal upward facing flange 72 which rests at its ends on the bottom rail webs 31. Vertical plates 73 welded to the ends of the flange 72 are bolted at 74 to the upstanding webs 32 of the bottom rails 30. By passing the bolts 74 through enlarged bolt holes 75 (FIGS. 5A) in one or both of the plates 73 and webs 32, the leftward end of the L section member 71 can be located precisely at the leftward end of the bottom rail 30. The leftward end of the L section member 71 is formed by an upstanding flange 77, the interior face 78 of which is sloped and thus faces somewhat upwardly as well as rightwardly. Threaded studs 81 are fixed (as by welding) to the exterior (leftward) face of the upstanding flange 77 and extend vertically thereabove. The L section member 71 preferably carries a pair of such studs 81 spaced transversely from each other and offset somewhat inboard from the bottom rails 30.

The portion of the connecting unit 61 of the rightward ends of the bottom frame rails 30 of the adjacent screed unit 20 comprises a downward facing substantially L section cross member 83 comprising a horizontal flange 84 which extends transversely between the upstanding webs 32. Vertical plates 85 welded to the ends of the flange 84 depend therefrom and affix same rigidly between the upstanding webs 32 by means of bolts 87 in the adjustable manner above discussed with respect to bolts 74. The top surface of the flange 84 is, in the preferred embodiment shown, substantially flush with the top edges of the upstanding webs 32. The horizontal flange 84 extends rightwardly beyond the end of the bottom rails 30 and at its outer (rightward) edge carries a depending flange 89 spaced outward beyond the ends of the connected bottom rails 30 sufficient to snugly grip, in face-to-face contact, the rightward face of the upstanding flange 77 when the ends of the bottom rails 30 of the adjacent screed units are in snub abutting contact, to longitudinally snugly lock together the ends of the bottom rails of the adjacent screed units 20, as indicated at 91 in FIGS. 5 and 5A. The inner (leftward) face of depending flange 89 is preferably sloped in parallel, complementary relation to the inner (rightward) face of the upstanding flange 77 engaged therewith. The transverse ends 92 (FIG. 5A) of the depending flange 89 lie snugly between the upstanding webs 32 of the adjacent screed unit to prevent relative sideward shifting between attached screed units 20. It will be noted that the plates 73 of the rightward screed unit are spaced rightwardly from the upstanding flange 77 fixed thereto by a sufficient space as not to interfere with or engage the depending flange 89 when two adjacent screed units are attached as in FIG. 5.

The upstanding threaded studs 81 extend upward loosely through the corresponding clearance holes 93 (FIG. 5A) in the downward facing horizontal flanges 84 of the adjacent screed unit. Capped hand nuts 97 (FIGS. 3 and 5) threadedly engage the tops of the studs 81 and are tightenable down against the top surface of the horizontal flange 84 to locate the bottom rails of the adjacent screed units in the same horizontal plane while simultaneously wedging the upstanding flange 77 tightly against the depending flange 89 and the ends of the bottom rails of the left and right screed units tightly against one another. The nut 96 includes a generously sized generally L-shaped handle 97 to permit tightening and loosening of the nut by hand without assistance of tools. Further, the covered, or cap nut, character of the nut 96, the location of the effective threaded portion of the studs 81 above the tops of the bottom rails 30 (and indeed during use above the horizontal flange 84) and the relatively large diameter (for example ¾ inch diameter) and consequent large cross section of the threads on the stud and nut, combine to minimize fouling of the threads, during use, by concrete being smoothed by the bottom rails 30. In contrast, the bolts 74 and 87, securing the plates 73 and the plates 85 to the bottom rails 30 are relatively small in diameter and fine threaded and come more frequently in contact with, and risk fouling by, concrete being smoothed. However, disconnection of adjacent screed units is effected through use of the studs 81 and nuts 96, and does not involve any loosening or tightening of the bolts 74 and 87, which normally are adjusted only prior to the initial use of a given screed unit to assure proper positioning of the L member 71 or 83 thereon.

Figure 9:
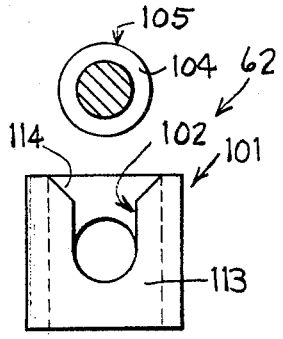
FIG. 9 is an enlarged cross-sectional view substantially taken on the line IX—IX of FIG. 3.

The connecting unit 62 joining the top rails 36 of adjacent screed units 20 comprises a yoke member 101 (FIGS. 3, 5 and 9) having a vertically opening slot 102 for receiving, in a drop-in manner, a grooved portion 104 in an enlarged head 105 carried by the adjacent screed unit 20.

In the preferred embodiment shown, the yoke member 101 comprises an upstanding boxlike tube 108, open at top and bottom, having an inner wall 109 fixed, as by a welded connection, to a stub shaft 111 (FIG. 5) held by screws 112 in the tubular end of the corresponding top rail 36. The tubular member 108 has an outer (leftward) upstanding wall 113 in which said slot 102 is cut, the slot preferably having a widened inlet portion at 114 to facilitate entry of the grooved portion of the head 105 thereinto. In the preferred embodiment shown, the slot 102 faces upward and is on the same end of the screed unit 20 as the above-described upstanding flange 77.

The grooved head 105 is fixed on the end extremity of an elongate screw 116 (FIG. 5) which, in the preferred embodiment, is threaded into an internally threaded tube 117 fixed by screws 118 within the tubular end of the top rail 36 of the adjacent screed unit 20. A lock nut 121 is threaded on the screw 116 and is axially engageable with the rightward end of the corresponding top rail 36 to lock the screw against axial threaded adjustment with respect to such corresponding top rail 36. The nut 121 and head 105 are each equipped with radially extending handles 124 and 125 of generous size to permit axial adjustment and locking, respectively, of the head 105 with respect to the corresponding leftward top rail 36.

Such axial threaded adjusting and locking of the screw 116 with respect to the leftward top rail 36, while the grooved head 105 is engaged in the slot 102 in the opposed end of the adjacent top rail 36, increases or reduces the separation between such adjacent top rail ends. By increasing such separation the fixed connection of the bottom rails of the two adjacent screed units 20 tends to raise the engaged screed unit ends and thus bow upwardly the screed 10 at this location. Conversely, reducing the separation between the adjacent top rail ends tends to lower engaged screed unit ends and hence to form a dip or depression in the screed 10 at this location. In this way, threaded adjustment of the screw 116 can be used to compensate for any tendency of the screed to bow upwardly or downwardly due to other causes, and so as to maintain, despite these other causes, a strictly linear longitudinal extent of the screed 10.

Figure 7:
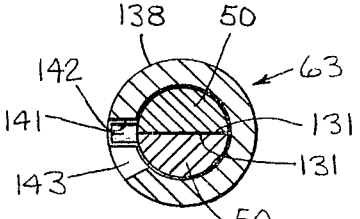
FIG. 7 is an enlarged cross-sectional view substantially taken on the line VII—VII of FIG. 5.

The connecting unit 63 (FIGS. 3, 5 and 7) for connecting the ends of adjacent shaft segments 50 comprises a diametrally extending flat 131 on each end of each shaft segment 50, the shaft segments 50 being rotated so that the diametral flats 131 on adjacent shaft segment ends abut each other when the corresponding screed units are attached as in FIGS. 5 and 7. To facilitate connection of adjacent screed units 20, the shaft segment 50 of each screed unit 20 is axially located, as by collars 133 (FIG. 3) fixed as by set screws or the like to the shaft segment 50 in flanking relation to one of the bearings 51 thereof, such that the shaft segment is axially offset with respect to the bottom frame rails 30 in the direction of the downward facing L section member 83 and away from the upward facing L section member 71 (and thus toward the right in FIG. 3). In this way, the diametral flat 131 at the rightward end of a shaft segment 50 is displaced rightwardly beyond the downward facing L section member 83 to connect with an adjacent diametral flat 131 which is offset longitudinally inboard of the upstanding flange 77 of the upward facing L section member 71 of the corresponding screed unit 20. Accordingly, the inboard offset of the leftward end of a shaft segment 50 precludes it from interfering with the rightward and downward movement of the downward facing L section member 83 needed to connect it with the adjacent upward facing L section member 71, despite the fact that the shaft segments 50 are conveniently located relatively closely above the L section members 83 and 71. This location of the shaft segments 50 is convenient because it permits direct mounting of conventional bearings (here of the pillow block type) 51 directly upon the cross members 38 and 39 extending between the bottom rails 30.

To permit drop-in connection of the adjacent ends of screed units 20, the diametral flat 131 above the upward facing L section member 71 is rotated to be upward facing and the diametral flat 131 associated with the downward facing L section member 83 is rotated to be downward facing, as seen in FIGS. 3 and 5. The facing of the diametral flats 131 on opposite ends of the same shaft section 50 may be as desired (for example both downward facing as in FIG. 3) because the shaft section 50 of one or the other of two screed units 20 being attached to each other can be rotated manually into the desired upward or downward facing position to place the adjacent shaft segment ends, to be joined, in their proper positions as shown in FIGS. 3 and 5 and described above.

To hold the diametral flats 131 of adjacent shaft segments 50 in their abutting, rotation-transmitting position of FIGS. 5 and 7, a tubular member 138 is slidably carried on one (here the leftward one) of the adjacent shaft segment ends to axially slide over and circumferentially closely surround the abutting shaft segment ends, thereby preventing any radial displacement of one from the other. To limit the axial motion of the tubular member 138 on its shaft segment 50, a pin 141 fixed to and radially extending from such shaft segment 50 is slidably located in a substantially L-shaped slot 142 piercing the wall of the tubular member 138 and comprising an axially extending leg 142 and a circumferentially extending leg 143. A compression spring 146, backed by a collar 147, fixed to the corresponding end of the shaft segment 50 urges the tubular member rightwardly over the abutting diametral flats 131, to the axial extent permitted by abutment of the pin 141 with the leftward end of the axial slot leg 142, as seen in FIG. 5, to maintain a rotational driving connection between the adjacent shaft sections 50. On the other hand, to disconnect the adjacent shaft segment ends, the tubular member 138 is shifted leftwardly, until the pin 141 abuts the rightward end of the axial slot leg 142, and then is rotated with respect to the pin 141 such that the latter enters and lodges in the circumferential slot leg 143, as shown in FIG. 3. In this FIG. 3 position, the spring 146 is tightly compressed and forcibly urges the surface of the circumferential slot leg 143 against the pin 141 so as to frictionally hold the tubular member 138 circumferentially and hence axially in place on its shaft segment 50, namely in its shaft-disconnecting position. In that position, the tubular member 138 is located entirely axially inboard from the diametral flatted end portion 131 of its shaft segment 50, such that the opposed flats 131 can be moved radially apart to completely disconnect the adjacent shaft segments 50.

To forwardly advance the screed 10 across an area of concrete to be smoothed, a pair of preferably identical winch units 160 (FIGS. 1, 3, 4 and 10) are removably locatable on any of the screed units 20 at any desired points along the top rails 36 thereof except where such top rails connect to the struts 34. Normally, it is convenient to place the winch units at opposite ends of the screed 10 at portions thereof extending past the form sides 12 and 13. The winch unit 160 comprises an elongated, normally substantially upstanding winch support member 162, preferably of a rearward opening channel section comprising a central web 163 and side flanges 164. The bottom of the side flanges 164 are angled at 166 (FIG. 4) so as to extend along the top of the bottom web of the forward bottom rail 30. The rear bottom portions of the side flanges are notched at 167 to receive the upstanding web 32 of the forward bottom rail 30. A substantially L-shaped bracket is welded to the back side of the channel member 162 to hook over and engage the back side of the upstanding web 32 of the forward bottom rail 30 to prevent forward movement of the channel member off the bottom rail.

A further substantially L-shaped bracket 171 is fixed as by means of a spacer block 172 and screws 173 to the back face of the central web 163 such that the top rail 36 is snugly received in a downward opening notch 175 cooperatively formed by the L-shaped member 171 and spacer block 172 as seen in FIG. 4.

The winch support unit 160 thus installs on the selected screed unit 20 (including a selected one of motor mounting screed units 20*a*–20*c*) simply by having its L-shaped brackets 171 and 169 slip down over and come to rest upon the top and bottom rails 36 and 30 as in FIGS. 3 and 4. To fix the winch support unit on the selected screed unit, a hand screw 177 is threadable through the lower leg of L bracket 171 to engage and tighten against the top rail 36. In the preferred embodiment shown, the top rail 36 is of circular cross section and the screw 177 bears thereagainst at a point spaced below a parallel diametral plane of the circular top rail to positively mechanically lock the winch support unit 160 to the screed unit. The channel member 162 extends above the bracket 171 to support a conventional hand-powered winch, or the like, 181 at a convenient working height. The winch line 182 (FIGS. 1 and 4) is led downward along the forward face of the channel member 162 to a pulley 184 supported for rotation by a bracket 185 on the lower end portion of the central web 163 to lead the winch line 182 forwardly, just above the level of concrete to be leveled, to suitable fixed means, such as a stake 187 or the like, spaced in front thereof.

The multi-unit screed 10 is normally transported to a job site, where an area of concrete is to be leveled, in a knocked-down condition with the screed units 20 and 20*a* (or 20*b* or 20*c*) separated from each other and the winch units 160 removed therefrom.

Once on the job site individual screed units 20 and 20*a* (or 20*b* or 20*c*) are selected to achieve a total screed length somewhat exceeding the width (from form 12 to form 13) of the concrete area to be smoothed. The screed units are then successively connected end-to-end in the desired order, to locate the motor support unit 20*a* (or 20*b* or 20*c*) at the desired location along the screed 10, for example in the central portion of the screed as in FIG. 1 or at one end of he screed as in FIG. 10. Each screed unit is connected to the next in the manner illustrated in the transition from FIG. 3 to FIG. 5. More particularly referring to FIG. 3, the screed unit 20 whose end to be connected has the upward facing components 102 and 77, is left in place. The complementary end (having downward facing components 105 and 83) of the next screed unit 20 is lifted off the ground so as to be somewhat higher than the corresponding upward facing components 102 and 77 on an adjacent screed unit. FIG. 3 shows the entire leftward screed unit being lifted above the level of the rightward screed unit but, in practice, it would be more convenient to simply lift the rightward end of the leftward screed unit off the ground, inasmuch as the resultant slight tilting of the leftward screed unit 20 will not interfere with connection of the leftward and rightward screed units. The lifted screed unit end is then moved rightwardly from its FIG. 3 position such that the groove 104 overlies the slot 102 and the holes 93 in the downward facing L bracket overlying the studs 81 in the upward facing bracket 71, and also so that the projecting downward facing diametral flat 131 on the leftward shaft segment 50 overlies the upward facing, inboard located diametral flat 131 on the rightward shaft segment 50. The raised end of the leftward screed unit 20 is then simply dropped upon the adjacent end of the rightward screed unit 20, so that the grooved portion 104 of head 105 enters the slot 102, the holes 93 in downward facing L bracket 83 receive the studs 81 upward therethrough, and the downward facing diametral flat 131 comes to rest on the upward facing diametral flat 131, and wherein also the depending and upstanding flanges 89 and 77 come into wedging engagement, all as shown in FIG. 5. The adjacent screed units 20 are now locked against longitudinal separation from each other and are longitudinally aligned as seen from the top thereof. To prevent the leftward screed unit from being lifted out of its engagement with the rightward screed unit, the hand nuts 96 are threaded down onto the tops of the studs 81 protruding upward through the horizontal flange 84. To prevent circumferential slippage between the adjacent shaft segments 50, the tubular member 138 is gripped by hand, while in its retracted position of FIG. 3, is rotated to its FIG. 7 condition to register the pin 141 with the axial groove leg 172, and then is allowed to be propelled by expansion of the spring 146 rightwardly in FIG. 5 into surrounding relation with the opposed diametral flats 131.

Normally it will not be necessary to adjust the screw 116. However, if for some reason the adjacent pair of screed units 20, at their joinder, tend to bow upwardly or downwardly, such can be compensated by releasing lock nut 121 and rotating the screw 116 in the appropriate direction to decrease or increase the axial separation between the ends of the adjacent top rails 36.

Thereafter, the winch units 160 are installable simply by dropping onto the desired locations along the length of the assembled screed unit 10, and the screws 177 are then tightened to lock the winch unit 160 in place on the screed 10. The screed 10 will normally be assembled, or placed after assembly, at the rear end of the form, stakes 187 or other suitable anchors are placed forwardly thereof and the winch lines 182 are led forwardly thereto.

Concrete is then added to the form ahead of the screed 10 in a conventional manner and with the motor 144 operating, to rotate the connected shaft sections 50 with their eccentric weights positioned as desired thereon for the desired degree of vibration, the winches on winch units 160 are manually cranked to advance the screed 10 forwardly along the form 14 to smooth the concrete therein.

Once the screeding job is completed, the screed 10 may be knocked down into condition for transporting to another job site, by a reversal of the above-described assembly process. As seen above, no tools are required either in assembly or disassembly of the screed 10.

It may be noted that the ability to positively and continuously adjust the effective axial length of the connection adjacent top rails 36 may be particularly helpful when, as in FIG. 10, it is desired to cantilever beyond the form wall 13, a substantial length of screed unit, particularly a screed unit 20*c* carrying the extra weight of the engine 44, and at the outboard end thereof a winch bracket 160, which due to the substantial weight carried and the substantial cantilever distance may tend to sag if not compensated by adjustment of the corresponding screw 116.

MODIFICATION

In the embodiment of FIGS. 11–14, the screed units 20*d* differ from the screed units 20 above described with respect to FIGS. 1–10, as follows.

First, the screed units 20*d* are preferably of lighter, more compact construction. To this end, the bottom rails 30*d* are of 90° angle cross-section, each comprising an upstanding web 202 and an underlying horizontal bottom web 203 which extends forwardly in the direction of travel, as indicated by arrow A. As the screed advances over concrete to be smoothed, the leading horizontal bottom web 203 of each bottom rail tends to cut into, and thus level hills of concrete in its path, rather than skimming over the top thereof and leaving holes in the concrete therebehind. This is assisted by the weight of concrete which collects atop the horizontal web 203 and against the forward face of the upstanding web 202.

Second, a modified bottom rail connecting unit 61*d* (FIGS. 11 and 13) comprises a preferably L-section cross member 206 extending between the ends of the bottom rails 30*d* of the rightward (FIG. 13) screed unit 20*d*. Cross member 206 is tilted to open horizontally inboard (rightward) and extends substantially from the top of the rail 30*d* to a location spaced above the bottom thereof. The cross member 206 comprises an upper flange 207 backed at its lower edge by a bracing flange 208, the upper flange 207 preferably being angled about 30' to the length of the bottom rails 30*d*. Vertical plates 211 welded to the ends of the cross member 206 are bolted at 212 to the upstanding webs 202 of the bottom rails 30*d* of the corresponding screed unit, the bolt holes preferably being somewhat oversized to permit accurate placement of the cross member 206 and end plates 211 on the end of the screed unit.

Each of the end plates 211 is provided at its free (leftward in FIG. 13) end with a horizontal wing 214 fixed as by welding atop the upper edge of the vertical plate 211 and extending laterally outboard therefrom to lie atop the upper edge of the corresponding upstanding flange 202 of the corresponding bottom rail. The outer (leftward) edges of the upper flange 207, vertical plate 211, and wing 214 preferably lie in a common vertical plane and are offset beyond the free ends of the supporting bottom rails 30*d* by an overhand distance D which in one unit was about $\frac{1}{4}$ inch.

A pair of parallel tubular sleeves 217 (FIGS. 11 and 12) are fixed, preferably by welding, to the top of upper flange 207 of cross member 206 near the vertical end plates 211. Each sleeve 217 extends from a bottom end which is preferably nearly flush with the bottom of flange 207 and extends at the angle of flange 207 upward beyond the top edge thereof and interiorly of the corresponding screed unit 20*d*. The longitudinal axis of the two sleeves 217 lie in respective vertical planes parallel to and flanking the central vertical longitudinal plane of the screed unit.

A boltlike member 221 has an elongate threaded shank 222 snugly but slidably and rotatably extending through the central bore of each sleeve 217 and is provided at its lower end with a radially widened, platelike head 223 fixed to the bottom end of the shank and extending radially therebeyond near the lower end of the sleeve 217. A hand actuable wing nut 224 is threaded on the upper end of the shank 222 protruding from the upper end of the sleeve 217.

The complementary portion of the bottom rail connecting unit 61*d*, which is secured on the opposed rightward end of the adjacent screed unit 20*d* comprises a similar but leftward opening L section cross member 226 (FIGS. 11 and 13) having an upper flange 227 sloped at about 60° to the horizontal bottom rail 30*d* backed at its lower edge by a bracing flange 228 and fixed at its ends, as by welding, to vertical end plates 231 adjustably fixed by bolts 232 to the upstanding webs 30*d* of the corresponding screed bottom rails. The outer (rightward in FIG. 13) edge of the cross member 226 may be offset somewhat inboard of the outer edge of end plates 231 but preferably lies in a common transverse vertical plane therewith, much as above described with respect to cross member 207 and end plates 211. Further, the outer (rightward or free) flush edges of cross member 226 and end plates 231 are offset inward from the free ends of the corresponding bottom rails 20*d* by a distance F (in the preferred embodiment about $\frac{3}{8}$ inch). Further, the upper flange 227 of the cross member 226 is provided with upwardly opening notches 242 (FIGS. 11 and 12) laterally located and sized to receive snugly but slidably therein the opposed lower ends of the shanks 222 of the boltlike members 221 on the opposite screed unit 20*d*.

Figure 11:
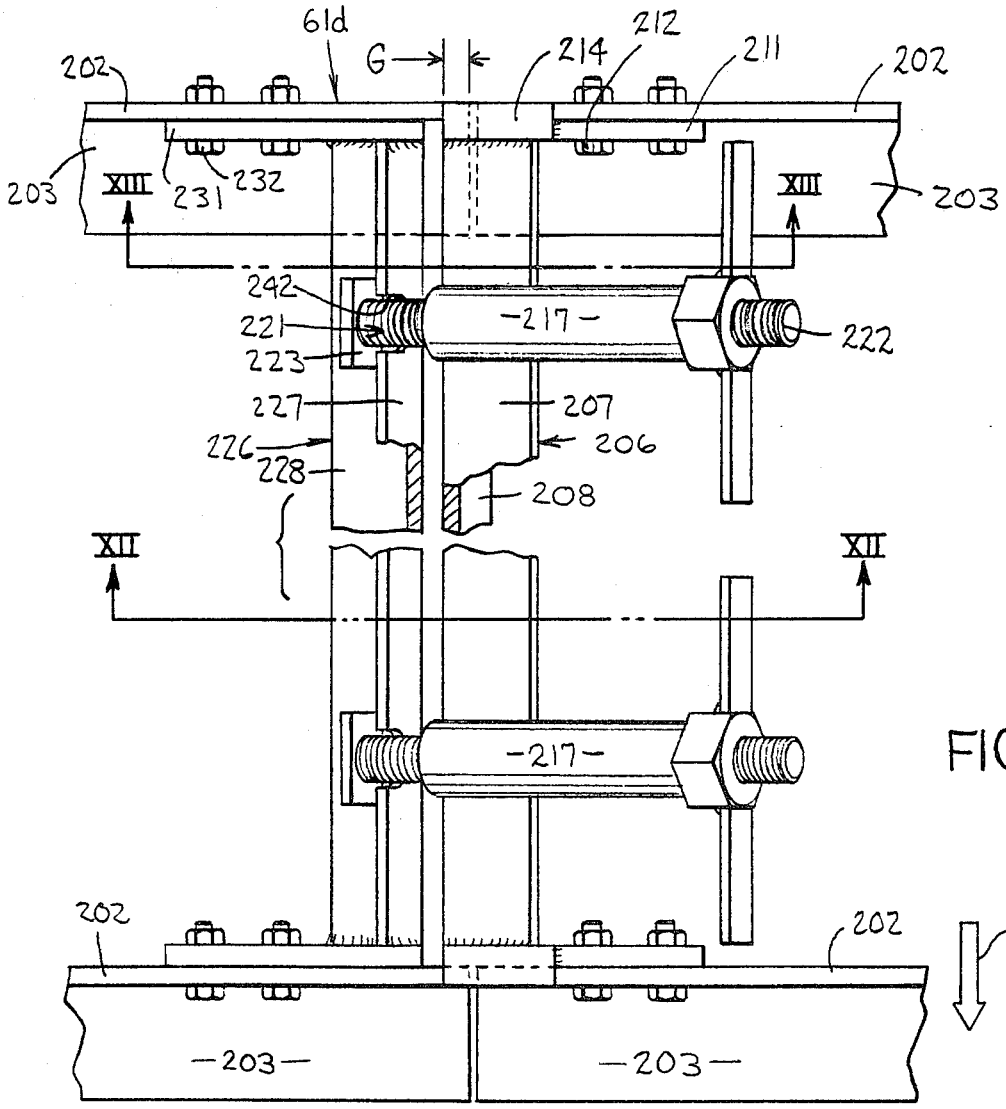
FIG. 11 is a fragmentary top view of a modified embodiment with the bolts partly tightened.
Figure 8:
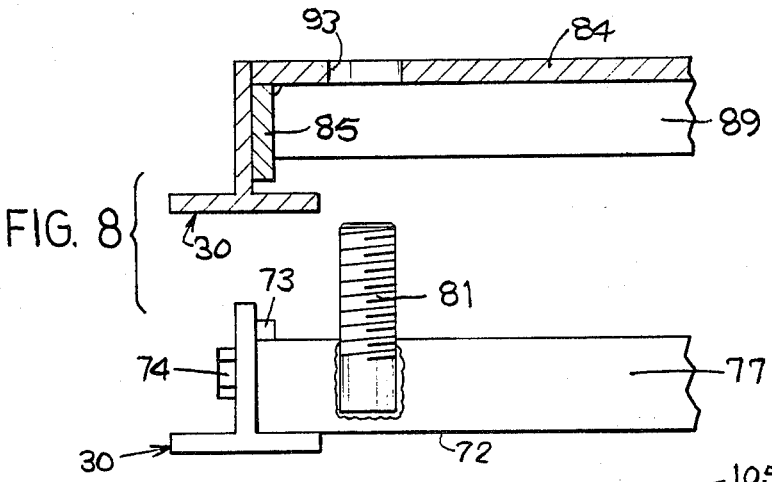
FIG. 8 is an enlarged fragmentary cross-sectional view substantially taken on the line VIII—VIII of FIG. 3.
Figure 14:
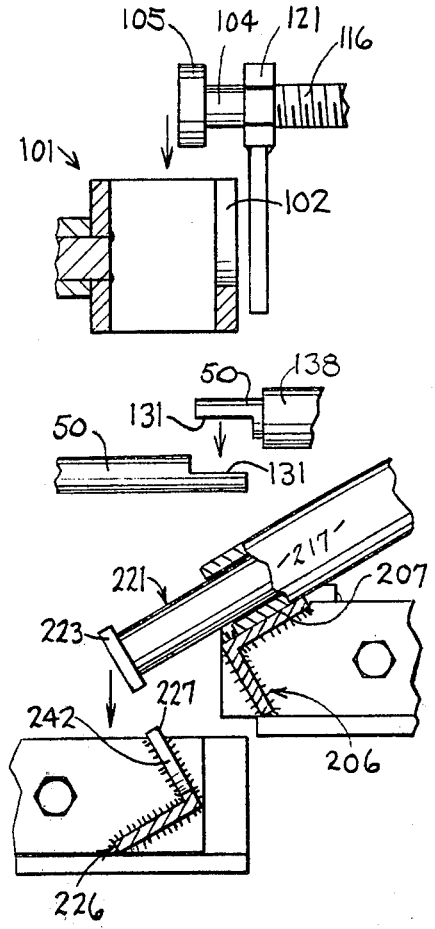
FIG. 14 is a view similar to FIG. 12 prior to drop-in engagement of the adjacent screed ends.

To form a screed of desired length, each screed unit is connected to the next in the manner illustrated in the transition from FIG. 14 to FIGS. 11–13. Just as above described with respect to the embodiment of FIGS. 1–10, connection is effected by dropping the end of one screed unit on the adjacent end of the next. More particularly, the screed unit 20*d* (the leftward one in FIG. 14) having the upward facing components 102 and 242 is left in place on the ground. The complementary end (having downward facing components 105 and 221) of the next (rightward) screed unit 20*d* is lifted off the ground and moved horizontally to the position of FIG. 14 wherein downward facing connecting portions of the lifted rightward screed unit 20*d* are near and directly overlie the corresponding upward facing connecting portions of the lower leftward screed unit 20*d*. The lifted end of the rightward screed unit 20*d* is then simply dropped upon the adjacent end of the leftward screed unit 20*d*, so that the grooved portion 104 of head 105 enters the slot 102, the downward facing diametral flat 131 of the rightward shaft 50 comes to rest on the upward facing diametral flat 131 of the leftward shaft 50, the exposed lower end of the shank 222 of each bolt 221 of the rightward screed unit 20*d* comes to rest in the corresponding upward facing recess 242 of the cross member 226 of the leftward screed unit 20*d*, and the overhanging free ends of the wings 214 of the rightward screed unit 20*d* come to rest upon the exposed free ends of the corresponding bottom rail upstanding flanges 202 of the leftward screed unit 20*d*, to place the screed units in the longitudinally aligned and connected position of FIGS. 11–13.

It will be noted that during this drop-in step (from FIG. 14 to FIG. 12) the nut 224 is left sufficiently loosened that the bolt head 223 is spaced from the end of sleeve 217 by a sufficient distance as to leftwardly clear the cross member flange 227 so as to enable the lower end of the shank 222 to the bolt 221 to drop freely into the upward facing notch 242 without interference between the bolt head 223 and the connecting member flange 227. Also during the drop-in step, it will be seen that the free leftward edge portions of the plates 211 slide snugly downwardly between the rightward free edge portions of the upstanding flanges 202 of the leftward screed unit 20*d* to precisely sidewardly center the two screed units with respect to each other, by means of the sideward overlap indicated at G in FIG. 11.

To positively lock together the frames of the thus end connected screed units 20*d*, the hand nuts 224 are threadedly tightened on the bolts 221 to pull the heads 223 of the latter forcibly up against the flange 227 of the cross member 226 of the adjacent screed unit. This pulls the rightward upper corners of the upstanding webs 202 of the leftward screed unit bottom rails against corresponding wings 214 in the overlapping relation generally indicated at H in FIG. 13, and positively maintains the sideward overlapping at G as above discussed, while forcibly positively abutting the opposed ends of the bottom rails 30*d* of the adjacent screed units. Because the upper flange 227 of L member 226 is angled counterclockwise away from the vertical (here at about 30°) the head 223 of the bolt 222, when the nut 224 is tightened, it is positively mechanically locked against upward escpae, so that the rightward screed unit 20*d* cannot be lifted up out of engagement with the leftward screed unit. Indeed, it is preferred that the flange 227 lie substantially at right angles to the axis of the bolt 222. The latter axis may lie in a range of about 15 to 60 degrees from the horizontal. The mentioned angle of about 30° in the embodiment shown in FIG. 12 provides less vertical interlocking force between the screed unit ends than would some larger (e.g. 45°)ngle but requires fewer locking and unlocking turns of the nut 224 to effect engagement and disengagement of the two screed unit ends.

Disassembly of the two screed unit ends from each other will be understood to involve simply reversal of the foregoing steps. The FIGS. 11–14 embodiment is advantageous in that, for example, it is not necessary to remove and replace the nuts 224 on the bolts 221 to disconnect and connect adjacent screed unit ends. This avoids the possibility of losing a removed nut which would prevent reassembly of the screed until a replacement nut is obtained. This also avoids possible difficulty and time wastage in restarting a nut on the end of the bolt, particularly if the threaded end of the bolt becomes burred or concrete coated by careless handling. The portion of the bolt threadedly engaged by the nut 224 is raised well above the bottom rails 30*d* and hence located well above the area of the apparatus which risks being coated with concrete. Further, the bolt 221 is of diameter (for example $\frac{5}{8}$ inch) substantially larger than the bolts commonly used to join parts to the bottom rails of Applicant's or other screed units (typically $\frac{1}{4}$ inch or $\frac{3}{8}$ inch diameter bolts), the larger diameter nut 224 and threaded bolt shank 222 thus having larger threads and hence being more likely to be capable of loosening and tightening even with some concrete material on such threads.

While constructable in various sizes, one set of screed units 20 constructed in accord with FIGS. 1–10 were about 16 inches high, weighted between 9 and 10 pounds per $7\frac{1}{2}$ foot long screed unit and have been used in screeds of length up to and beyond 50 feet. While the nodified FIG. 11 screed unit is also constructable in various sizes, it is favored for screeds at the shorter end of the length range. In one set of screed units constructed with the FIG. 11 modification, the screed units were about 10 inches high, weighed between 5 and 6 pounds per $7\frac{1}{2}$ foot long screed unit and were found convenient for screeds up to about 35 feet long.

Although preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A knock-down vibrating concrete screed comprising elongate screed units attachable end-to-end in a longitudinally extending row to provide a screed of desired length, two of said screed units each comprising an elongate frame unit movable transversely over the concrete and vibration means for vibrating the corresponding frame unit for smoothing the concrete over which the frame unit moves, said two screed units having adjacent ends with coacting means for (1) positively blocking strictly coaxial longitudinal movement of said two screed units from detached into attached relation with each other, (2) blocking strictly coaxial longitudinal movement of said two screed units out of attached relation with each other, and (3) attaching the adjacent ends of said two screed units in response to longitudinal overlapping of said adjacent ends while transversely separated followed by movement of said adjacent ends one toward the other in one direction transverse to the length of the screed into an attached position of longitudinal alignment in which the thus longitudinally overlapped ends positively block further movement in said one direction.

2. The apparatus of claim 1 wherein said coacting means on said adjacent ends of said screed units comprise respective connecting means for positively connecting said elongate frame units and vibrating means of adjacent screed units.

3. The apparatus of claim 1 wherein said coacting means include complementary shaped, transversely opposed, engageable means on the adjacent ends of said screed units, said complementary shaped means including transversely overlapping longitudinally opposed portions fixed to adjacent screed unit ends which portions provide said positive blocking of strictly coaxial longitudinal movement of said adjacent screed units into and out of attached relation, said screed further including releasable connectors actuable for locking said attached screed unit ends against reverse transverse movement away from each other, namely against movement in a direction opposite said one direction.

4. The apparatus of claim 2 wherein said vibrating means comprises a rotatable shaft section on each frame unit, said connecting means including axially slidable complementary shaped, transversely opposed, engageable means on the adjacent ends of the shaft sections of attached frame units for transmitting rotation from one said shaft section to the next, and means releasably slidable over said transversely opposed ends of said shaft sections for holding same in said rotation transmitting relation.

5. The apparatus of claim 4 in which said releasably slidable means comprises a tubular member snugly slidable over said shaft sections, a spring contained axially between said tubular member and a fixed backing member on one of said shaft sections for urging said tubular member to a position surrounding for their full lengths said transversely opposed ends of said shaft sections for holding same in said rotation transmitting relation, said one shaft section having a pin protruding radially therefrom adjacent said shaft section ends, said tubular member having a substantially L-shaped slot through the wall thereof for receiving said pin slidably therein, said L-shaped slot including an axially elongate leg permitting sliding of said tubular member off the opposed ends of said shaft sections and against the force of said spring, said slot further having a substantially circumferentially extending leg at the end of said slot furthest from said spring to permit rotation of said pin thereinto to hold the tubular member away from said opposed shaft section ends to permit lifting of one shaft section end from the other thereof as a part of the separation of adjacent screed units.

6. The apparatus of claim 4 in which said engageable means of adjacent shaft segments are longitudinally offset in one direction from the corresponding connecting means joining the lower portions of adjacent frame units.

7. The apparatus of claim 1 wherein said frame units comprise a lower frame portion for engaging and smoothing concrete as the screed is moved transversely over the concrete and an upper frame portion spaced above said lower frame portion, said coacting means including interengageable lower connecting means on the ends of the lower frame portions of adjacent screed units for said blocking of longitudinal movement of said screed units with respect to each other, said coacting means including interengageable upper connecting means on the ends of the upper frame portions of adjacent screed units also for said blocking of longitudinal movement of said screed units with respect to each other, said lower and upper connecting means allowing transverse separation of said adjacent screed unit ends in a direction opposite said one direction.

8. The apparatus of claim 1 wherein coacting means on said adjacent ends of said screed units comprise drop-in connecting means including substantially upward facing portions on one screed unit end overlaid by and complementary to substantially downward facing portions on the adjacent screed unit end such that connection of said one screed unit to the adjacent screed unit is initiated by dropping the end of said one screed unit onto the adjacent end of said adjacent screed unit.

9. The apparatus of claim 8 wherein adjacent frame units each have horizontally spaced longitudinally alignable bottom rails, said drop-in connecting means on said one screed unit end comprising an upstanding flange extending transversely between the ends of said bottom rails of said one screed unit in fixed relation thereto, said drop-in connecting means on said adjacent screed unit end comprising a substantially horizontal flange extending between and fixed with respect to said bottom rails on said adjacent screed unit, said horizontal flange extending beyond the ends of said adjacent screed unit bottom rails snugly between the ends of the bottom rails of said one screed unit and overlying said upstanding flange of said one screed unit, said horizontal flange pendently supporting at its end a depending flange fixed thereto and disposed snugly between said bottom rails of said one screed unit, the interior faces of said upstanding flange and depending flange abutting one another to preclude longitudinal separation of said screed units, said upstanding and depending flanges defining said upward facing and downward facing portions, respectively.

10. The apparatus of claim 9 in which said upstanding and depending flanges are provided with abutting faces which slope somewhat with respect to the vertical in a manner to progressively longitudinally tighten the connection between said one and adjacent screed units as said adjacent screed unit is moved downward into coplanar relation with said one screed unit.

11. The apparatus of claim 9 in which at least one upright threaded stud is fixed to the exterior face of said upstanding flange and extends upward therebeyond, said horizontal flange being provided with a clearance hole for loosely receiving therethrough the upper portion of said threaded stud, said drop-in connecting means further including a nut member threadable onto the upper end of said threaded stud to force said horizontal flange downward toward said upstanding flange and thereby wedge said one and adjacent screed units into tight end engagement of their bottom rails.

12. The apparatus of claim 11 in which said drop-in connecting means of said one screed unit comprises a further horizontal flange fixed to the bottom of said upstanding flange and extending inward along the bottom rails of said one screed unit, such that said upstanding and horizontal flanges of said one screed unit and said horizontal and depending flanges of said adjacent screed unit each form an L cross-section member, said L cross-section members being equipped at each transverse end thereof with a mounting plate, said mounting plates being secured for longitudinal adjustment to the bottom rails of their respective screed units for precise end-to-end securement of said one and adjacent screed units.

13. The apparatus of claim 8 in which said frame units have coaxially alignable longitudinally extending top rails, said drop-in connecting means comprising means defining an upward opening slot on said one screed unit and fixed to the top rail thereof, said drop-in connecting means further including a grooved head fixed to said top rail of said adjacent screed unit and downwardly insertable into said upward opening slot at the grooved portion thereof to longitudinally interlock the top rails of said one and adjacent screed units.

14. The apparatus of claim 13 in which said drop-in connecting means includes threaded means in series with said grooved head and slot and threadedly adjustable with respect to one of said top rails for changing the longitudinal spacing of the opposed ends of the top rails of said one and adjacent screed units.

15. The apparatus of claim 14 in which said grooved head and threaded means constitute a screw threaded into the end of the top rail of said adjacent screed unit and including a lock nut threaded on said screw and engageable with the end of said top rail of said adjacent screed unit for locking said screw in position thereon, said means defining said upward opening slot being a slotted flange member fixed to the end of said one screed unit, said head and lock nut being provided with radially extending handles for adjusting the longitudinal separation between said top rails of said one and adjacent screed units without need for tools, said head being removable from said slot by upward movement therefrom without need to adjust said screw.

16. The apparatus of claim 1 including an upstanding winch support member, releasable locking means for releasably locking said winch support member to said frame unit, said locking means being carried by said winch support member without corresponding locking means on said frame unit, such that said winch support member is fixable to any of several said frame units at any of several longitudinally spaced locations thereon to help in adapting the screed to a range of widths of concrete to be smoothed, means for locating a winch spaced above the bottom of said frame unit at a convenient height for actuation, means for leading a line down from said winch to a point near the bottom of said frame and thence forward along the path of travel of said screed to an anchor point for forwardly moving the screed.

17. The apparatus of claim 16 in which a said frame unit is substantially of triangular cross section, comprising a pair of transversely spaced longitudinal bottom rails and a longitudinally extending top rail spaced above and between said bottom rails, said upstanding winch support member having a substantially L-shaped bracket fixed to the back side thereof near the bottom thereof for hooking over the front one of said bottom frame rails, said winch support member having an upper substantially L-shaped bracket fixed to the back side thereof and hooked over the top rail of said frame unit and including hand-operable means on said upper L bracket for releasably fixing said winch support member to said top rail and against movement with respect to said screed unit, said means for leading comprising a pulley member fixed to the forward facing bottom end portion of said winch support member substantially at the height of said bottom frame rails.

18. The apparatus of claim 8 wherein adjacent frame units each have horizontally spaced longitudinally alignable bottom rails, said rails on said one and adjacent screed units having longitudinally opposed abuttable surfaces and vertically opposed respectively upward and downward facing abuttable surfaces, said drop-in connecting means including upwardly and downwardly facing locking elements on said one and adjacent screed units respectively, at least one of said locking elements being actuable to force together the bottom rails of said one and adjacent screed units along a line oriented as an acute angle to the longitudinal axis of said screed.

19. The apparatus of claim 18 in which the locking element on said one screed unit comprises a flange angled up and away from said adjacent screed unit and having an upward facing notch, the locking element on said adjacent screed unit comprising a retractable member angled upward and away from said flange, the lower end of said retractable member being receivable into said notch and being headed to pull said one screed unit toward said adjacent screed unit.

20. The apparatus of claim 19 in which said vertically opposed abuttable surfaces comprise a wing on said adjacent screed unit overhanging the bottom rail on said one screed unit to block upward movement of said one screed unit therepast, said retractable member comprising a bolt, means on said adjacent screed unit for slidably supporting said bolt for longitudinal movement thereof along said acutely angled line and a nut threaded on the upper end of said bolt and engageable against the upper end of said supporting means and tightenable for pulling the headed lower end of said bolt forcibly against said flange to thereby pull the lower frame rails of said adjacent screed unit downward and toward the opposed bottom frame rails of the one screed unit and into tight longitudinal alignment therewith.

21. The apparatus of claim 8 in which adjacent screed units have horizontally spaced longitudinally alignable bottom rails, said drop-in connecting means on said one and adjacent screed units each comprising an L-section cross member extending transversely between said bottom rails and having upstanding end plates adjustably fixed to said frame rails, the end plates on said adjacent screed unit having horizontal wings resting atop the corresponding bottom frame rails and with said end plates extending beyond said frame rails to overlap top and side surfaces of the bottom rails of said one screed unit, the cross member on said adjacent screed unit having an upper flange angled at about 30° to the horizontal and extending inboard from the free edge of said end plates thereof, a sleeve fixed to said flange and angling inboard and upward at approximately 30° to the horizontal, a bolt having a shank received slidably through said sleeve and provided with a hand adjustable nut at the threaded upper end thereof engageable against the upper end of said sleeve for tightening of said bolt, the cross member on said one screed unit having a flange angled upward and away from said adjacent screed unit and substantially perpendicular to the axis of said bolt, said flange having an upward facing notch for receiving the shank of said bolt between the lower end of said sleeve and the lower end of said bolt shank, the lower end of said bolt shank fixedly carrying an enlarged head engageable in abutting relation with the flange upon tightening of said nut to pull said adjacent screed unit downward into abutting relation with said one screed unit to lock same into longitudinally aligned relation.

* * * * *